US011865609B2

(12) United States Patent
Ozaki et al.

(10) Patent No.: US 11,865,609 B2
(45) **Date of Patent: *Jan. 9, 2024**

(54) METHOD FOR MANUFACTURING POWDER-MODIFIED MAGNESIUM ALLOY CHIP

(71) Applicant: SEIKO EPSON CORPORATION, Tokyo (JP)

(72) Inventors: Koichi Ozaki, Okayama (JP); Tadao Fukuta, Kurashiki (JP); Yasutoshi Hideshima, Nagano (JP); Makoto Kato, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/207,814

(22) Filed: Mar. 22, 2021

(65) Prior Publication Data

US 2021/0291266 A1 Sep. 23, 2021

(30) Foreign Application Priority Data

Mar. 23, 2020 (JP) ..... 2020-050633
Nov. 16, 2020 (JP) ..... 2020-190118

(51) Int. Cl.
*B22F 1/148* (2022.01)
*B22F 1/068* (2022.01)
*B22D 17/00* (2006.01)

(52) U.S. Cl.
CPC ..... *B22D 17/007* (2013.01); *B22F 1/068* (2022.01); *B22F 1/148* (2022.01);
(Continued)

(58) Field of Classification Search
CPC ..... C22C 23/00; C22C 23/02; C22C 23/04; C22C 23/06; B22F 1/00; B22F 1/0003; B22F 1/0059; B22F 1/0062; B22F 1/007; B22F 1/0074; B22F 1/0077; B22F 1/0081; B22F 1/0085; B22F 1/0096; B22F 1/02; B22F 1/025; B22F 2001/0066; B22F 9/02; B22F 9/026; B22F 9/04; B22F 2301/058; B22F 2302/40; B22F 2302/403;
(Continued)

(56) References Cited

U.S. PATENT DOCUMENTS 6,126,712 A * 10/2000 Hohne ..... B22F 1/148 75/246
2002/0040077 A1* 4/2002 Hanejko ..... C23C 26/00 427/372.2
(Continued)

FOREIGN PATENT DOCUMENTS

CN 101439405 A 5/2009
JP 2012/137907 A 7/2014
(Continued)

*Primary Examiner* — Vanessa T. Luk
(74) *Attorney, Agent, or Firm* — Global IP Counselors, LLP

(57) ABSTRACT

A method for manufacturing a powder-modified magnesium alloy chip for thixomolding includes a drying step of heating a mixture containing an Mg chip containing Mg as a main component, a C powder containing C as a main component, a binder, and an organic solvent to dry the organic solvent contained in the mixture, and a stirring step of stirring the mixture heated in the drying step.

6 Claims, 3 Drawing Sheets

(52) U.S. Cl.
CPC ..... *B22F 2301/058* (2013.01); *B22F 2302/40* (2013.01); *B22F 2303/01* (2013.01); *B22F 2303/20* (2013.01)

(58) Field of Classification Search
CPC ..... B22F 2302/406; B22F 2303/01; B22F 2303/20; B22F 2303/25
See application file for complete search history.

(56) References Cited

U.S. PATENT DOCUMENTS

| | | | | |
|---|---|---|---|---|
| 2006/0034723 | A1* | 2/2006 | Poszmik | B22F 1/10 419/10 |
| 2006/0057015 | A1 | 3/2006 | Kondoh | |
| 2006/0219056 | A1 | 10/2006 | Larink, Jr. | |
| 2008/0213118 | A1 | 9/2008 | Kondoh | |
| 2014/0023547 | A1 | 1/2014 | Mitooka et al. | |
| 2016/0074942 | A1* | 3/2016 | Fang | B22F 1/0003 419/32 |

FOREIGN PATENT DOCUMENTS

| | | | | |
|---|---|---|---|---|
| KR | 1020160106843 | A * | 9/2016 | B22F 1/16 |
| WO | 2004/062837 | A1 | 5/2006 | |

* cited by examiner

FIG. 3

| | EXAMPLE, COMPARATIVE EXAMPLE | FEED AMOUNT OF BINDER (%) | FEED AMOUNT OF C POWDER (%) | DRYING TEMPERATURE (°C) | DRYING TIME (min) | THE NUMBER OF REPETITIONS | DEGREASING TEMPERATURE (°C) | DEGREASING TIME (min) | ATTACHMENT AMOUNT (%) | ATTACHMENT RATIO (%) | DETERMINATION OF INJECTION DEFECT |
|---|---|---|---|---|---|---|---|---|---|---|---|
| SAMPLE 1 | EXAMPLE | 5 | 10 | 65 | 120 | 4 | 400 | 120 | 8.9 | 89 | A |
| SAMPLE 2 | EXAMPLE | 5 | 10 | 65 | 120 | 4 | 250 | 720 | 9.0 | 90 | A |
| SAMPLE 3 | COMPARATIVE EXAMPLE | 5 | 10 | 65 | 120 | 4 | — | — | 9.4 | 94 | B |
| SAMPLE 4 | EXAMPLE | 5 | 10 | 65 | 120 | 1 (CONTINUOUS) | 350 | 120 | 8.9 | 88 | A |
| SAMPLE 5 | EXAMPLE | 5 | 10 | 55 | 240 | 6 | 350 | 120 | 8.8 | 88 | A |
| SAMPLE 6 | EXAMPLE | 5 | 10 | 75 | 60 | 3 | 350 | 120 | 9.1 | 91 | A |
| SAMPLE 7 | COMPARATIVE EXAMPLE | 5 | 10 | 65 | 120 | 4 | 200 | 720 | 9.2 | 92 | B |
| SAMPLE 8 | EXAMPLE | 8 | 20 | 75 | 60 | 3 | 350 | 120 | 18.0 | 90 | A |
| SAMPLE 9 | EXAMPLE | 8 | 30 | 75 | 60 | 3 | 350 | 120 | 27.0 | 90 | A |
| SAMPLE 10 | EXAMPLE | 9 | 30 | 75 | 60 | 3 | 350 | 120 | 28.0 | 93 | A |
| SAMPLE 11 | COMPARATIVE EXAMPLE | — | 10 | 65 | 120 | 4 | 350 | 120 | 0.8 | 8 | A |
| SAMPLE 12 | COMPARATIVE EXAMPLE | — | 10 | 65 | 120 | 4 | — | — | 0.9 | 9 | A |
| SAMPLE 13 | COMPARATIVE EXAMPLE | — | 10 | 65 | 120 | 1 (CONTINUOUS) | 350 | 120 | 0.7 | 7 | A |
| SAMPLE 14 | COMPARATIVE EXAMPLE | — | 20 | 75 | 60 | 3 | 350 | 120 | 0.8 | 4 | A |

METHOD FOR MANUFACTURING POWDER-MODIFIED MAGNESIUM ALLOY CHIP

The present application is based on, and claims priority from JP Application Serial Number 2020-050633, filed Mar. 23, 2020, and JP Application Serial Number 2020-190118, filed Nov. 16, 2020, the disclosure of which is hereby incorporated by reference herein in its entirety.

BACKGROUND

1. Technical Field

The present disclosure relates to a method for manufacturing a powder-modified magnesium alloy chip.

2. Related Art

In recent years, components made of magnesium alloy are used in products such as an automobile, an aircraft, a mobile phone, and a notebook computer. Since magnesium has a higher strength than iron, aluminum, or the like, the components manufactured using the magnesium alloy can be lightweight and have a high strength. Further, the magnesium also has an advantage in terms of resource acquisition since the magnesium is abundant near a surface of the earth.

A method of manufacturing the components made of magnesium includes thixomolding. In the thixomolding, since a material whose fluidity is increased by heating and shearing is injected into a mold, it is possible to mold a thinner component or a component having a complicated shape compared to a die casting method. Further, since the material is injected into the mold without being exposed to an atmosphere, there is also an advantage that a molded product can be molded without using a flameproof gas such as $SF_6$.

For example, WO2012/137907 discloses a technique of coating a surface of a magnesium alloy material with a carbon powder in order to improve a bending characteristic and a tensile strength of a molded product by thixomolding. In WO2012/137907, 100 g, that is, 0.1% by weight of carbon black is added to 100 kg of a magnesium alloy chip, and both of them are mixed by a mixer to coat a surface of the magnesium alloy chip with the carbon powder.

An amount of an additive such as a carbon powder coating a magnesium alloy material is preferably an amount at which a desired characteristic of a molded product can be implemented. Therefore, it may be desired to coat the magnesium alloy material with a larger amount of additives in order to implement the desired characteristic of the molded product.

SUMMARY

According to a first aspect of the present disclosure, a method for manufacturing a powder-modified magnesium alloy chip for thixomolding is provided. The method includes: a stirring step of stirring a mixture containing an Mg chip containing Mg as a main component, a C powder containing C as a main component, a binder, and an organic solvent; and a drying step of heating the mixture to dry the organic solvent contained in the mixture.

BRIEF DESCRIPTION OF THE DRAWINGS

FIG. 3 is a diagram showing an evaluation result of powder-modified magnesium alloy chips.

DESCRIPTION OF EXEMPLARY EMBODIMENTS

A. Embodiment

Figure 1:
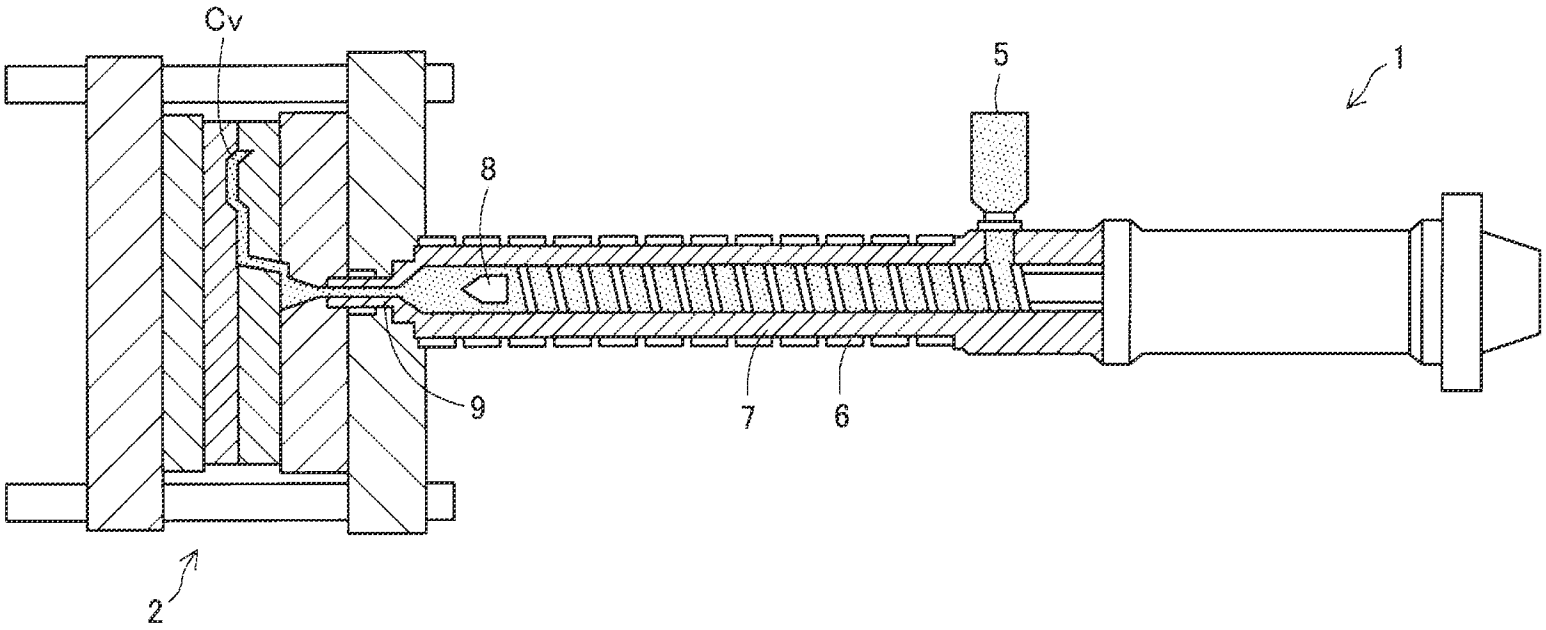
FIG. 1 is a schematic view showing an example of a configuration of an injection molding machine.

FIG. 1 is a schematic view showing an example of a configuration of an injection molding machine 1 used in thixomolding. The thixomolding is a method in which a material having a chip shape or a material such as a powder is slurried by heating and shearing, and the slurry is injected without coming into contact with an atmosphere to obtain a molded product having a desired shape. In the thixomolding, the molded product is generally molded at a lower temperature as compared to a die casting method or the like, and a structure of the molded product tends to be uniform. Therefore, a mechanical strength and a dimensional accuracy of the molded product can be improved by molding the molded product by the thixomolding. In the present specification, a term "molded product" is simply referred to as a product molded by the thixomolding.

The molded product obtained by the thixomolding is used for components constituting various products. The molded product is used in various structures such as an ornament, an artificial bone, an artificial tooth root, and an electronic device component such as a personal computer component, a mobile phone terminal component, a smartphone component, a tablet terminal component, a wearable device component, and a camera component, in addition to a transportation equipment component such as an automobile component, a railroad vehicle component, a ship component, and an aircraft component.

As shown in FIG. 1, the injection molding machine 1 includes a mold 2 that defines a cavity Cv, a hopper 5, a heating cylinder 7 including a heater 6, a screw 8, and a nozzle 9. When the thixomolding is performed by the injection molding machine 1, first, the material is fed into the hopper 5. The fed material is supplied from the hopper 5 to the heating cylinder 7. The material supplied to the heating cylinder 7 is slurried by being heated in the heating cylinder 7 by the heater 6 and being transferred and sheared by the screw 8. The slurry is injected through the nozzle 9 into the cavity Cv in the mold 2 without coming into contact with the atmosphere.

Figure 2:
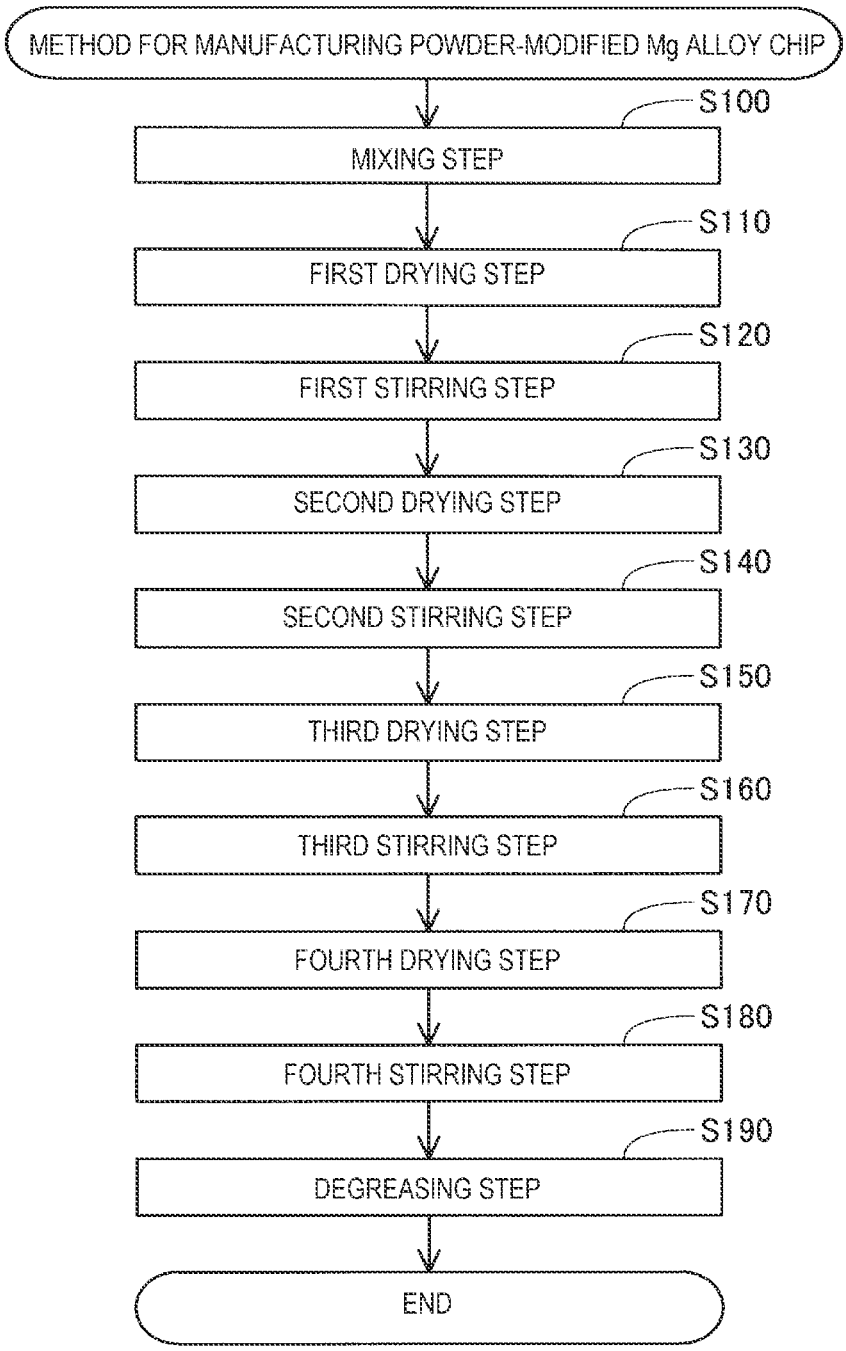
FIG. 2 is a process diagram showing a method for manufacturing a powder-modified magnesium alloy chip.

FIG. 2 is a process diagram showing a method for manufacturing a powder-modified magnesium (Mg) alloy chip according to the present embodiment. The powder-modified Mg alloy chip is used as a material for the thixomolding described above.

First, in step S100, a mixture is generated. In step S100, an Mg chip containing Mg as a main component, a C powder containing carbon (C) as a main component, a binder, and an organic solvent are mixed to obtain a mixture containing these substances. The main component refers to a substance having a highest content among substances contained in the Mg chip or the C powder.

The Mg chip refers to a section obtained by shaving or cutting an Mg alloy cast in a mold or the like. The Mg chip may have a different composition or shape as long as the Mg chip is a chip containing Mg as the main component. The chip may also be referred to as a pellet.

The Mg chip may contain various additive components in addition to Mg as the main component. For example, the Mg chip may contain aluminum (Al) as an additive component. An addition of Al to the Mg chip reduces a melting point of the Mg chip.

The Mg chip may contain other components as additive components in addition to the above-described Al. Examples of the other components include, for example, lithium, beryllium, silicon, manganese, iron, nickel, copper, zinc, strontium, yttrium, zirconium, silver, tin, gold, and rare earth elements such as cerium, and at least one kind of them may be added. The other component is more preferably at least one selected from a group consisting of manganese, yttrium, strontium, and rare earth elements. By adding these additive components to the Mg chip, a mechanical property, a corrosion resistance, a wear resistance, and a thermal conductivity of the Mg chip can be improved.

The above-described additive components may exist in a state of simple substances, oxides, intermetallic compounds, for example, in the Mg chip or the powder-modified Mg alloy chip. Further, the additive components may be segregated at a crystal grain boundary of a metal structure such as Mg or the Mg alloy or may be uniformly dispersed in the Mg chip or the powder-modified Mg alloy chip.

In the present embodiment, a SEAST "116" manufactured by Tokai Carbon Corporation is used as the C powder. The SEAST "116" is a carbon black having an arithmetic average particle diameter of 38 nm. The C powder may be, for example, another carbon black. Further, as a form different from the present embodiment, the Mg chip may be modified with a powder different from the C powder. In this case, a ceramic powder, a metal powder, or the like may be used as a powder different from the C powder.

In the present embodiment, a paraffin wax "115" manufactured by Nippon Seiyaku Corporation is used as the binder. As the binder, an organic binder other than the paraffin wax "115" may be used. In this case, for example, a hydrocarbon resin-based hot melt adhesive may be used, or another type of organic binder may be used. Further, as the binder, for example, an inorganic binder such as a binder containing an inorganic polymer such as an alkali silicate may be used.

In the present embodiment, isopropanol (IPA) is used as the organic solvent. An organic solvent other than the IPA may be used as the organic solvent. In this case, it is preferable to use an organic solvent suitable for dispersing the binder. As the organic solvent, for example, acetone or the like can be used.

In the manufacture of the powder-modified Mg alloy chip, step S100 may be omitted. For example, a mixture in which the Mg chip, the C powder, the binder, and the organic solvent described above are mixed in advance is prepared in advance, and the prepared mixture may be used from step S110 on.

In step S110, a first drying step is performed. A drying step is a step of heating the mixture to dry the organic solvent contained in the mixture. The first drying step refers to a drying step performed at a first time in the manufacture of the powder-modified Mg alloy chip according to the present embodiment. Similarly, a second drying step, a third drying step, and a fourth drying step to be described later also refer to the drying step respectively performed at a second time, a third time, and a fourth time.

In step S120, a first stirring step is performed. A stirring step is a step of stirring the mixture heated in the drying step. The first stirring step refers to a stirring step performed at a first time in the manufacture of the powder-modified Mg alloy chip according to the present embodiment. Similarly, a second stirring step, a third stirring step, and a fourth stirring step to be described later also refer to the stirring step respectively performed at a second time, a third time, and a fourth time. In the stirring step, for example, the mixture may be directly stirred with a stirring rod or a stirrer, or the mixture in a container may be stirred by shaking the container containing the mixture.

In step S130, the second drying step is performed, and in step S140, the second stirring step is performed. Next, in step S150, the third drying step is performed, and in step S160, the third stirring step is performed. Further, in step S170, the fourth drying step is performed, and in step S180, the fourth stirring step is performed.

By performing the first drying step to the fourth drying step and the first stirring step to the fourth stirring step, the C powder is attached to the Mg chip. The "attachment" includes a state in which the C powder is directly attached to the Mg chip, and a state in which the C powder is attached to the Mg chip via another element such as the binder. Further, the C powder may be attached to the Mg chip in a multilayer manner. In the present embodiment, by attaching the C powder not only directly to the Mg chip but also to the Mg chip via the binder, an amount of the C powder attached to the Mg chip increases as compared with a case where no binder is used. The state in which "the C powder is attached to the Mg chip" may be referred to as a state in which "the C powder modifies the Mg chip". Further, the state in which "the C powder is attached to the Mg chip" may be referred to as a state in which "the C powder covers the Mg chip".

In the present embodiment as described above, the drying steps and the stirring steps are alternately performed for a plurality of times. Accordingly, the C powder is likely to be attached to the Mg chip in the multilayer manner.

In step S190, a degreasing step is performed. The degreasing step is a step of heating the mixture to remove at least a part of the binder contained in the mixture. In the present embodiment, in the degreasing step, the mixture is heated at a degreasing temperature of 250° C. or higher and 450° C. or lower.

The method for manufacturing the powder-modified Mg alloy chip according to the present embodiment described above includes the stirring steps of stirring the mixture containing the Mg chip, the C powder, the binder, and the organic solvent, and the drying steps of heating the mixture to dry the organic solvent contained in the mixture. Therefore, an amount of the C powder that modifies a surface of the Mg chip increases as compared to the case where no binder is used.

Further, in the present embodiment, the drying steps and the stirring steps are alternately performed for the plurality of times. Therefore, the C powder is likely to be attached to the Mg chip in the multilayer manner, and the amount of the C powder that modifies the Mg chip is stabilized.

Further, in the present embodiment, after the stirring steps and the drying steps are completed, the degreasing step is performed. Therefore, during molding, generation of a gas derived from the binder from the powder-modified Mg alloy chip is prevented, and a molding accuracy of the molded product is improved.

Further, in the present embodiment, in the degreasing step, the mixture is heated at the temperature of 250° C. or higher and 450° C. or lower. Therefore, in the degreasing step, since the mixture is heated at a temperature lower than a melting point of Mg, the binder is effectively degreased and a thermal influence on the Mg chip is prevented.

In another embodiment, in manufacture of a powder-modified alloy chip, drying steps and stirring steps may not be alternately performed for four times. For example, the drying step and the stirring step may be performed once. Further, the number of times the drying steps and stirring steps are performed may respectively be two or three, or five times or more. The number of times the drying steps and the stirring steps are repeated may be referred to as the number of repetitions. In the manufacturing method shown in FIG. 2, the number of repetitions is four. Further, for example, the drying step and the stirring step may be performed at the same time, and the stirring step may be performed for a plurality of times or once while the drying step is continuously performed. Further, a timing at which the stirring step is performed may be determined by an experiment.

Further, in another embodiment, the degreasing temperature may be less than 250° C. or greater than 450° C. In this case, the degreasing temperature is preferably lower than the melting point of Mg. Further, for example, the degreasing step may not be performed. Even in this case, the amount of the C powder that modifies the surface of the Mg chip increases compared to the case where no binder is used.

B. Evaluation Result

FIG. 3 is a diagram showing an evaluation result of powder-modified Mg alloy chips manufactured according to the manufacturing method shown in FIG. 2. FIG. 3 shows a feed amount of the binder and a feed amount of the C powder in the mixing step, a drying temperature and drying time in the drying step, the number of repetitions of the stirring steps and the drying steps, a degreasing temperature and degreasing time in the degreasing step, and a determination result of injection defect during injection molding when the powder-modified Mg alloy chips were manufactured as a sample. Further, FIG. 3 shows an attachment amount of the C powder and an attachment ratio of the C powder in the manufactured powder-modified Mg alloy chips. Details of the attachment amount and the attachment ratio of the C powder and details of the determination result of the injection defect during the injection molding will be described later.

Samples 1 to 10 were manufactured according to the manufacturing method shown in FIG. 2. Samples having the number of repetitions other than 4 were also manufactured through the same steps as those of the manufacturing method shown in FIG. 2 except that the number of repetitions was different. First, in the mixing step of step S100, 500 g of the Mg chip, the C powder, and the binder dispersed in 35 ml of the organic solvent were fed into a container-with-lid kept warm at a mixing temperature by a thermostatic oven to obtain a mixture. As the Mg chip, a 4 mm×2 mm×1 mm chip of AZ91D manufactured by STU, Inc. was used. The chip is an Mg alloy chip containing 9% by weight of Al and 5% by weight of Zn. As the C powder, the SEAST "116" manufactured by Tokai Carbon Corporation was used. As the binder, the paraffin wax "115" manufactured by Nippon Seiyaku Corporation was used. As the organic solvent, the IPA was used. The feed amounts of the C powder and the binder are shown in FIG. 3 as a ratio to the Mg chip for each sample. For example, in the sample 1, since an addition amount of the C powder is 10%, a weight of the fed C powder is 50 g.

Next, as steps corresponding to step S110 to step S180 shown in FIG. 2, the drying steps and the stirring steps were performed. Specifically, in the drying step, the organic solvent of the mixture was dried by keeping a temperature of the mixture at the drying temperature and allowing the drying time to elapse in a state in which a lid of the container-with-lid placed in the thermostatic oven was opened. In the drying step, time per drying step was determined by dividing time of all drying steps by the number of repetitions. For example, in the sample 1, since the number of repetitions is 4, time of each of the first drying step to the fourth drying step is set to one quarter of the drying time of all drying steps. Specifically, in the sample 1, since the drying time is 120 minutes, the time of each of the first drying step to the fourth drying step is 30 minutes. In the sample 5, since the drying time is 240 minutes and the number of repetitions is 6 times, time of each of the first drying step to a sixth drying step is 40 minutes. The drying time and the drying temperature of all drying steps are shown in FIG. 3 for each sample.

Further, the stirring step was performed for the number of times corresponding to the number of repetitions. Specifically, in samples in which the number of repetitions is two or more, one stirring step was performed each time after one drying step was completed. For example, in the sample 1, after each of the first drying step to the fourth drying step was completed, a respective one of the first stirring step to the fourth stirring step was performed. In the sample 5, after each of the first drying step to the sixth drying step was completed, a respective one of the first stirring step to a sixth stirring step was performed. In the stirring step, the mixture in the container-with-lid was stirred by closing the lid of the container-with-lid and shaking the container-with-lid.

In manufacture of samples in which the number of repetitions shown in FIG. 3 is one, the drying step and the stirring step were performed at the same time. For example, in the sample 4, while the drying step was continuously performed once for 120 minutes, the stirring step was continuously performed for 120 minutes.

After the drying step and the stirring step were completed, the same degreasing step as in step S190 was performed. Specifically, in the degreasing step, the sample was degreased by heating the sample with an electric furnace. The degreasing temperature and the degreasing time in the degreasing step are shown in FIG. 3 for each sample. In manufacture of the sample 3, the degreasing step was not performed after the drying steps and the stirring steps were completed.

Samples 11 to 14 were manufactured without using the binder. That is, in manufacture of the samples 11 to 14, as a step corresponding to step S100 of FIG. 2, a step of mixing only the chip, the C powder, and the organic solvent was performed. Then, the steps from step S110 on were performed in the same manner as in the case of manufacturing the samples 1 to 10, and the samples 11 to 14 were obtained. In manufacture of the sample 12, the degreasing step was not performed after the drying steps and the stirring steps were completed.

The attachment amount of the C powder in FIG. 3 refers to a ratio of a weight of the C powder attached to the Mg chip with respect to a weight Mc of the fed Mg chip. The attachment ratio of the C powder refers to a ratio of a weight of the C powder attached to the chip with respect to a weight Mp of the fed C powder.

The attachment amount and the attachment ratio of the C powder were evaluated by measuring weights before and after washing of the powder-modified Mg alloy chip. Specifically, first, as a weight M1 before the washing, the weight of the powder-modified Mg alloy chip immediately after being manufactured according to the manufacturing method described above was measured. Then, the powder-modified Mg alloy chip was impregnated in acetone, washed with an ultrasonic cleaner for 10 minutes and dried, and then the weight of the powder-modified Mg alloy chip was measured, and the weight was taken as a weight M2 after the washing. At this time, the attachment amount of the C powder is represented by (M2−M1)/Mc×100%. The attachment ratio of the C powder is represented by (M2−M1)/Mc×100%. For example, when a binder other than the paraffin wax "115" was used in the manufacture of the sample, a cleaning agent for cleaning the sample may not be acetone. In this case, as the cleaning agent, a cleaning agent capable of washing off the binder and the C powder from the powder-modified Mg alloy chip without reacting with Mg is used.

As shown in FIG. 3, when the samples 1 to 7 and the samples 11 to 13 in which the feed amount of the C powder is 10% are compared, the attachment amounts and the attachment ratios in the samples 1 to 7 were larger than the attachment amounts and the attachment ratios in the samples 11 to 13. Further, when the sample 8 and the sample 14 in which the feed amount of the C powder is 20% are compared, the attachment amount and the attachment ratio in the sample 8 were larger than the attachment amount and the attachment ratio in the sample 14. Further, the feed amounts of the C powder in the samples 9 and 10 were larger than the feed amounts of the C powder in the samples 11 to 14, the attachment amounts and the attachment ratios in the samples 9 and 10 were larger than the attachment amounts and the attachment ratios in the samples 11 to 14. Further, when the samples 1 to 10 are compared, even when the feed amount of the C powder was increased, the attachment amount of 80% by weight or more was implemented.

In the samples 1 to 10, it is assumed that the attachment amounts and the attachment ratios were larger than the attachment amounts and the attachment ratios in the samples 11 to 14 since the C powder is attached to the chip via the binder.

From the above experimental results, it was confirmed that in the sample manufactured according to the manufacturing method of the embodiment, the amount of the C powder that modifies the surface of the chip increases compared to a sample manufactured by a method without using the binder.

The determination result of the injection defect in FIG. 3 indicates a result of determining an injection defect when the sample manufactured according to the manufacturing method of the embodiment was supplied to the injection molding machine and a molded product was molded. The molded product was molded using a magnesium injection molding machine JLM75MG (manufactured by Japan Steel Works). A process of injecting the material from the hopper 5 of the injection molding machine into the cavity Cv in the mold 2 is as described above. Injection conditions were a heater temperature of 600° C. and a mold temperature of 210° C. The material supplied to the cavity Cv in the mold 2 cools and hardens, at least a molded product, a sprue, a gate, and a runner are formed in the mold 2, and a cold plug is formed in the nozzle 9. Then, the cold plug and the sprue are separated by separating the nozzle 9 from the mold 2. When the material is re-injected into the cavity Cv in the mold 2, the cold plug is separated from the nozzle 9 and hardened by a cold plug trap (not shown).

However, when an amount of gas generated when the powder-modified magnesium alloy chip is heated in the heating cylinder 7 is large, pressure in the heating cylinder 7 is unintentionally increased and accordingly the cold plug may be separated from the nozzle 9 at a timing different from a predetermined timing. The injection defect described above means that the cold plug is unintentionally separated from the nozzle 9.

As shown in FIG. 3, when the samples 1 to 10 in which the attachment amount of the C powder is 10% or more are compared, no injection defects were confirmed in the samples 1 and 2, 4 to 6, and 8 to 10 in which the degreasing step was performed at a degreasing temperature of 250° C. or higher, and injection defects were confirmed in the sample 3 in which the degreasing step was not performed and in the sample 7 in which the degreasing step was performed at a degreasing temperature of less than 250° C.

In the samples 1, 2, 4 to 6, and 8 to 10, it is assumed that an amount of gas generated from the powder-modified magnesium alloy chip was reduced when the powder-modified magnesium alloy chip was melted in the injection molding method because the degreasing step was performed at a degreasing temperature of 250° C. or higher.

From the above experimental results, it was confirmed that, in the sample manufactured according to the manufacturing method of the embodiment, the gas generated in the heating cylinder of the injection molding machine was reduced as compared to that in a sample manufactured by a method without a degreasing step or a sample manufactured by a method with a degreasing step performed at a degreasing temperature of less than 250° C.

C. Other Aspects

The present disclosure is not limited to the above-described embodiment and can be implemented in various aspects without departing from the spirit of the present disclosure. For example, the present disclosure can be implemented by the following aspects. In order to solve a part or all of technical problems of the present disclosure, or to achieve a part or all of effects of the present disclosure, technical characteristics in the above-described embodiment corresponding to technical characteristics in each of aspects to be described below can be replaced or combined as appropriate. The technical characteristics can be deleted as appropriate unless described as necessary in the present specification.

(1) According to a first aspect of the present disclosure, a method for manufacturing a powder-modified magnesium alloy chip for thixomolding is provided. The method includes a drying step of heating a mixture containing an Mg chip containing Mg as a main component, a C powder containing C as a main component, a binder, and an organic solvent to dry the organic solvent contained in the mixture, and a stirring step of stirring the mixture heated in the drying step.

According to such an aspect, an amount of the C powder that modifies a surface of the Mg chip increases as compared to a case where no binder is used.

(2) In the method for manufacturing the powder-modified magnesium alloy chip according to the aspect, the drying step and the stirring step may be alternately performed for a plurality of times. According to such an aspect, the C powder is likely to be attached to the Mg chip in the multilayer manner, and the amount of the C powder that modifies the Mg chip is stabilized.

(3) In the method for manufacturing the powder-modified magnesium alloy chip according to the aspect, the drying step and the stirring step may be performed at the same time. According to such an aspect, since the drying step and the stirring step can be performed efficiently with a simple method, it is possible to efficiently manufacture the powder-modified magnesium alloy chip in which the amount of the C powder that modifies the surface of the Mg chip is increased.

(4) In the method for manufacturing the powder-modified magnesium alloy chip according to the aspect, after the stirring step and the drying step are completed, a degreasing step of heating the mixture to remove at least a part of the binder contained in the mixture may be performed. According to such an aspect, during molding, generation of a gas derived from the binder from the powder-modified magnesium alloy chip is prevented, and molding accuracy of a molded product is improved. Further, when the powder-modified magnesium alloy chip according to the aspect is used in a molded product manufactured by an injection molding method, in a step of melting a chip in an injection molding machine, the generation of the gas derived from the binder in the injection molding machine such as the heating cylinder 7 can be prevented. In this case, it is possible to prevent pressure inside the injection molding machine from increasing due to the generation of the gas.

(5) In the method for manufacturing the powder-modified magnesium alloy chip according to the aspect, in the degreasing step, the mixture may be heated at a temperature of 250° C. or higher and 450° C. or lower. According to such an aspect, since the mixture is heated at a temperature lower than the melting point of Mg, the binder is effectively degreased and a thermal effect on the Mg chip is prevented.

The present disclosure is not limited to the method for manufacturing the powder-modified magnesium alloy chip described above, and may be implemented in various aspects. For example, the present disclosure can be implemented in a form of a molded product including the powder-modified magnesium alloy chip.

What is claimed is:

1. A method for manufacturing a powder-modified magnesium alloy chip for thixomolding, the method comprising:

a drying step of heating a mixture containing an Mg chip containing Mg as a main component, a C powder containing C as a main component, a binder, and an organic solvent to dry the organic solvent contained in the mixture;

a stirring step of stirring the mixture heated in the drying step; and a degreasing step of heating the mixture to remove at least a part of the binder contained in the mixture after the stirring step and the drying step are completed so that an attachment amount of the C powder attached to the Mg chip is 8.8% or greater and 28.0% or less after removal of the part of the binder, the attachment amount being a ratio of a weight of the C powder attached to the Mg chip with respect to a weight of the Mg chip, wherein the drying step and the stirring step are alternately performed for a plurality of times.

2. The method for manufacturing a powder-modified magnesium alloy chip according to claim 1, wherein in the degreasing step, the mixture is heated at a temperature of 250° C. or higher.

3. The method for manufacturing a powder-modified magnesium alloy chip according to claim 2, wherein in the degreasing step, the mixture is heated at a temperature of 450° C. or lower.

4. A method for manufacturing a powder-modified magnesium alloy chip, the method comprising:

a drying step of heating a mixture containing an Mg chip containing Mg as a main component, a C powder containing C as a main component, a binder, and an organic solvent to dry the organic solvent contained in the mixture;

a stirring step of stirring the mixture; and a degreasing step of heating the mixture to remove at least a part of the binder contained in the mixture after the stirring step and the drying step are completed so that an attachment amount of the C powder attached to the Mg chip is 8.8% or greater and 28.0% or less after removal of the part of the binder, the attachment amount being a ratio of a weight of the C powder attached to the Mg chip with respect to a weight of the Mg chip, wherein the drying step and the stirring step are performed at the same time.

5. The method for manufacturing a powder-modified magnesium alloy chip according to claim 4, wherein in the degreasing step, the mixture is heated at a temperature of 250° C. or higher.

6. The method for manufacturing a powder-modified magnesium alloy chip according to claim 5, wherein in the degreasing step, the mixture is heated at a temperature of 450° C. or lower.

* * * * *